US006484789B1

(12) United States Patent
Ober

(10) Patent No.: US 6,484,789 B1
(45) Date of Patent: Nov. 26, 2002

(54) SELF SUPPORTING FILLER FOR CLOSING AN OPENING THROUGH A STRUCTURE

(76) Inventor: Ronald S. Ober, 6 Gurdon's La., Gloucester, MA (US) 01930

( * ) Notice: Subject to any disclaimer, the term of this patent is extended or adjusted under 35 U.S.C. 154(b) by 0 days.

(21) Appl. No.: 09/872,556

(22) Filed: Jun. 1, 2001

(51) Int. Cl.[7] ..... A47H 23/00
(52) U.S. Cl. ..... 160/354; 160/104
(58) Field of Search ..... 160/354, 104, 160/105, 371; 52/202; 49/57, 463

(56) References Cited

U.S. PATENT DOCUMENTS

| | | | | |
|---|---|---|---|---|
| 109,422 | A | * 11/1870 | Kimberly | |
| 2,263,813 | A | * 11/1941 | Mason | |
| 2,297,729 | A | * 10/1942 | Thomas | |
| 2,531,670 | A | * 11/1950 | Cain | |
| 2,850,087 | A | 9/1958 | Janaman | 160/105 |
| 3,064,725 | A | * 11/1962 | Roark | |
| 3,763,917 | A | 10/1973 | Antinone | 160/354 |
| 4,330,022 | A | 5/1982 | Bull et al. | 160/379 |
| 4,463,790 | A | 8/1984 | Clapsaddle | 160/105 |
| 4,993,471 | A | 2/1991 | Golden | 160/370.2 |
| 5,003,905 | A | 4/1991 | Raynor | 114/201 |
| 5,048,587 | A | 9/1991 | York | 160/217 |
| 5,161,478 | A | 11/1992 | Strieb | 114/361 |
| 5,299,616 | A | 4/1994 | Sholtz | 160/89 |
| 5,469,906 | A | 11/1995 | Cason | 160/105 |
| 5,669,190 | A | * 9/1997 | Szyjkowski | |
| 5,765,312 | A | * 6/1998 | Szyjkowski | |
| 5,937,596 | A | * 8/1999 | Leeuwenburgh et al. | |
| 6,086,128 | A | * 7/2000 | Whitehead, Sr. | |

* cited by examiner

*Primary Examiner*—Blair M. Johnson
(74) *Attorney, Agent, or Firm*—George A. Herbster

(57) ABSTRACT

A filler for an opening through a structure. The filler includes a panel, a base frame of a closed cell foam that is flexible and has a memory characteristic. The base frame carries the panel. A flexible cover overlies portions of the central panel whereby the base frame and cover capture the panel therebetween.

8 Claims, 7 Drawing Sheets

SELF SUPPORTING FILLER FOR CLOSING AN OPENING THROUGH A STRUCTURE

BACKGROUND OF THE INVENTION

1. Field of the Invention

This invention generally relates to screens and other fillers for openings in various structures. More specifically this invention relates to fillers that close an opening through a structure, that are self-supporting in use and that facilitate storage when not in use.

2. Description of Related Art

Screens and other like fillers are used in a variety of applications to close an opening, through a structure as, for example, an opening through a building , automobile or boat. For example, U.S. Pat. No. 3,763,917 (1973) to Antinone discloses a filler in the form of a detachable flexible screen for protecting garages, porches, terraces and summerhouses from annoying pests. The detachable flexible screen includes a sheet of screening material binding for upper and lower horizontal margins and vertical margins. The binding includes a strip of water-resistant flexible material folded longitudinally and disposed about the margins of the sheet.

In U.S. Pat. No. 5,048,587 (1991) to York a portable screen door insert constitutes a self-supporting filler in a standard door frame. The frame of the screen door insert is hinged to fold in half upon itself to provide compact storage.

A number of fillers have been developed for use in automobiles. For example, U.S. Pat. No. 2,850,087 (1958) to Janaman discloses a portable automobile screen with frame members that support a screen material and with a vertically disposed hinged joint that connects the frame members. The upper and side edges of the hinged assembly are shaped to fit within the upper and side window channel grooves of an automobile window when the screen is in a flat or open position.

In U.S. Pat. No. 4,463,790 (1984) to Clapsaddle a filler in the form of a removable automobile window screen includes a pair of flexible and resilient elongated blocks. Each block has a pair of longitudinal edges and a plurality of ventilation holes. The blocks are in At abutment at positions along, but slightly spaced from, their longitudinal edges. A flexible elongated screen is abutably disposed between the blocks. The window screen possesses sufficient rigidity to extend to the opposing window frame elements when disposed in the window opening, yet possesses sufficient flexibility to be longitudinally rolled when not disposed in the window opening.

U.S. Pat. No. 4,993,471 (1991) to Golden discloses a self-mounting vehicle screen including a flexible screen material with mounting means along its periphery. The mounting means are resilient projections that temporarily entangle with the fabric surrounding the vehicle opening so the screen may be detached and reattached repeatedly.

In U.S. Pat. No. 5,299,616 (1994) to Sholtz, a vehicle window screen has a screen portion and a surrounding frame. The frame is secured along the edge of and interiorly of the vehicle window. The window is hinged attached along one edge to a side of the vehicle.

U.S. Pat. No. 5,469,906 (1995) to Cason discloses a screen assembly for a rear window of a vehicle. The assembly comprises a generally rectangular frame adapted to fit into the rear window opening in each vehicle. Upper and lower channels in each of the horizontal frame sides are adapted to receive at least one closure member that closes a portion defined by the frame. A screen with a peripheral support fits within the frame. The frame is detachably disposed relative to the closure member to fill the area defined by the frame so the screen can be readily removed from the frame.

Pleasure sail and power boats define another application for such removable fillers for purposes of closing hatches and companionways. Such fillers with screens prevent bugs from entering a cabin but enhance ventilation. Fillers with transparent panels allow exterior light illuminate a cabin interior, but prevent pests and rain from entering the cabin. For example, U.S. Pat. No. 5,003,905 (1991) to Raynor discloses a collapsible hatch screen. A square-shaped screen frame is rigid on all four sides and bendable in all four corners. A square-shaped piece of screening sized to fit within the screen frame and a square-shaped border member which covers the screen frame is attached to all four edges of the piece of screening. The screen frame then can be folded and rolled up into a compact configuration for storage.

U.S. Pat. No. 5,161,478 (1992) to Strieb also discloses a temporary insert screen for boats and the like. The screen comprises a central section of conventional screening material, an edging and an outer edge. The edging is formed of a strong, lightweight material with a sewn hem into which a weighted chain is attached. The weighted chain resides in full pressure contact about an opening to be screened on the boat when the screen is installed. The edging is positioned in abutting broad contact with any framing means of the opening to better withstand frictional abuse generated by frequency of contact.

These references disclose screens with one configuration for use and another configuration for storage. The Clapsaddle, Raynor and Strieb patents further disclose screens that minimize storage volume when the screens are not in use. The Clapsaddle patent specifically discloses a multiple element structure that requires interaction with other elements in order to be supported in an automobile window. Further, the filler is narrow and provides minimal amount of air flow through the unit. The Raynor and Strieb patents maximize the amount of screen area that covers an opening to enhance ventilation. The Raynor patent with its collapsible frame and material that attaches to the hatch frame is complicated to manufacture and requires multiple steps to use. Moreover, in boats some hatch frames are finished wood, so the application of a strip of hook and loop material detracts from the overall aesthetics of a cabin and may release from the hatch frame with use. The Strieb patent eliminates the need for a hook and loop material by utilizing a chain. The use of a chain or other weighted edge construction requires that a significant portion of the screen lie on a horizontal surface. Moreover, installation from inside the cabin can be difficult because the weighted edge lies on the exterior of the cabin. The chain also adds cost. Should the screen fall overboard, the weight of the chain will cause the screen to sink quickly. What is needed, but not disclosed in the foregoing references, is a one piece filler for an opening through a structure, such as a building opening, automobile window or boat hatch or companionway, that is self-supporting, rigid, lightweight and that is adapted for easy use in a variety of configurations.

SUMMARY

Therefore it is an object of this invention to provide a filler for an opening through a structure that is self-supporting in a planar orientation.

Another object of this invention is to provide a filler for an opening through a structure that does not require any modification to the supporting structure.

Yet another object of this invention is to provide a filler for an opening through a structure in which a peripheral frame supporting a central panel constitutes a minimum portion of the total area of the structure opening.

Still another object of this invention is to provide a self-supporting planar filler that is flexible for facilitating storage between uses.

Yet still another object of this invention is to provide a filler for a structural opening that is inexpensive to manufacture.

Still yet another object of this invention is to provide a filler for a structural opening that is easy to install and remove.

In accordance with this invention, a filler for an opening through a structure comprises a flexible panel, a planar base frame and a cover. The planar base frame has an opening therethrough and is composed of a closed cell foam material with density, memory and flexibility characteristics that allow the frame to be folded and to relax to a substantially planar configuration. The cover has an opening therethrough coextensive with the opening through the base frame whereby the base frame and cover support the panel by capturing its edges therebetween.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
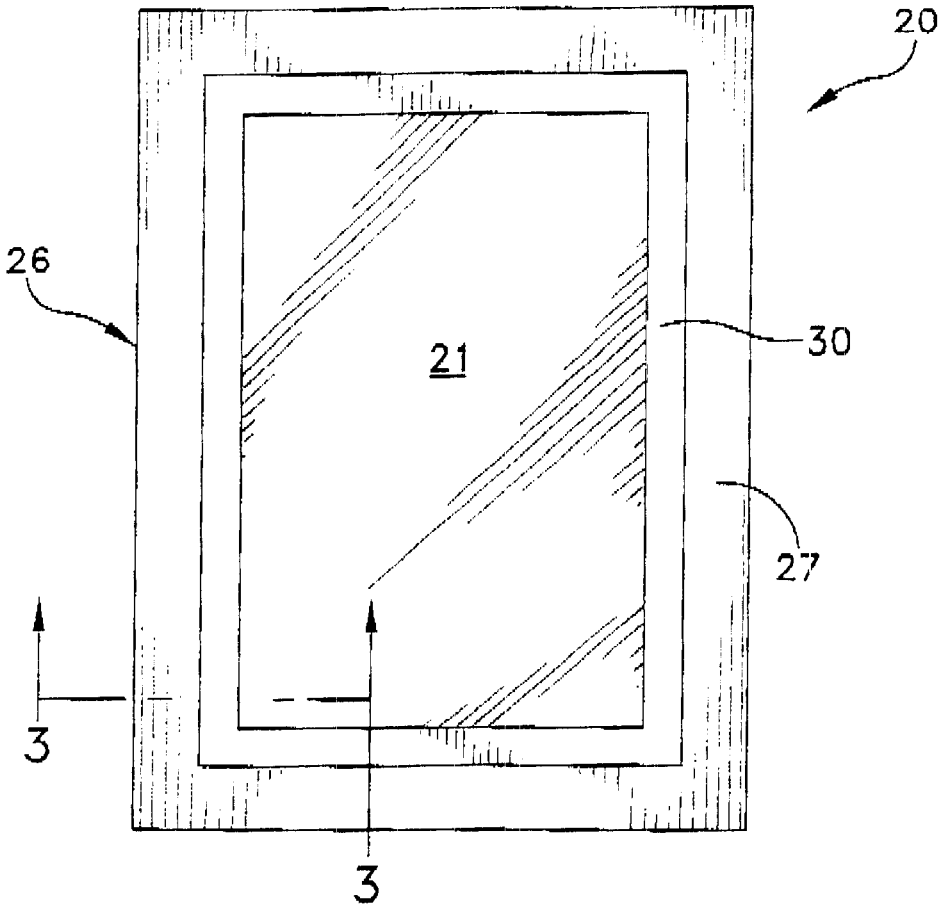
FIG. 1 is a plan view of a filler constructed in accordance with this invention with a transparent panel.
Figure 3:
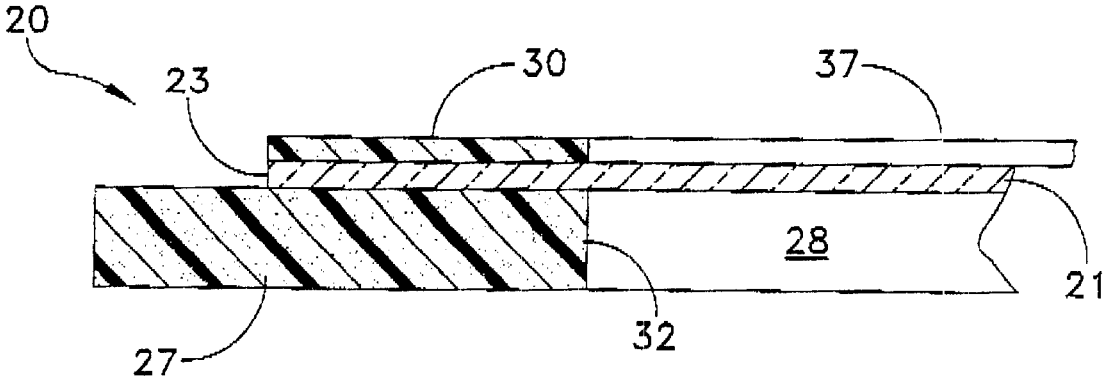
FIG. 3 is a cross-section view taken along lines 3—3 in FIG. 1.
Figure 2:
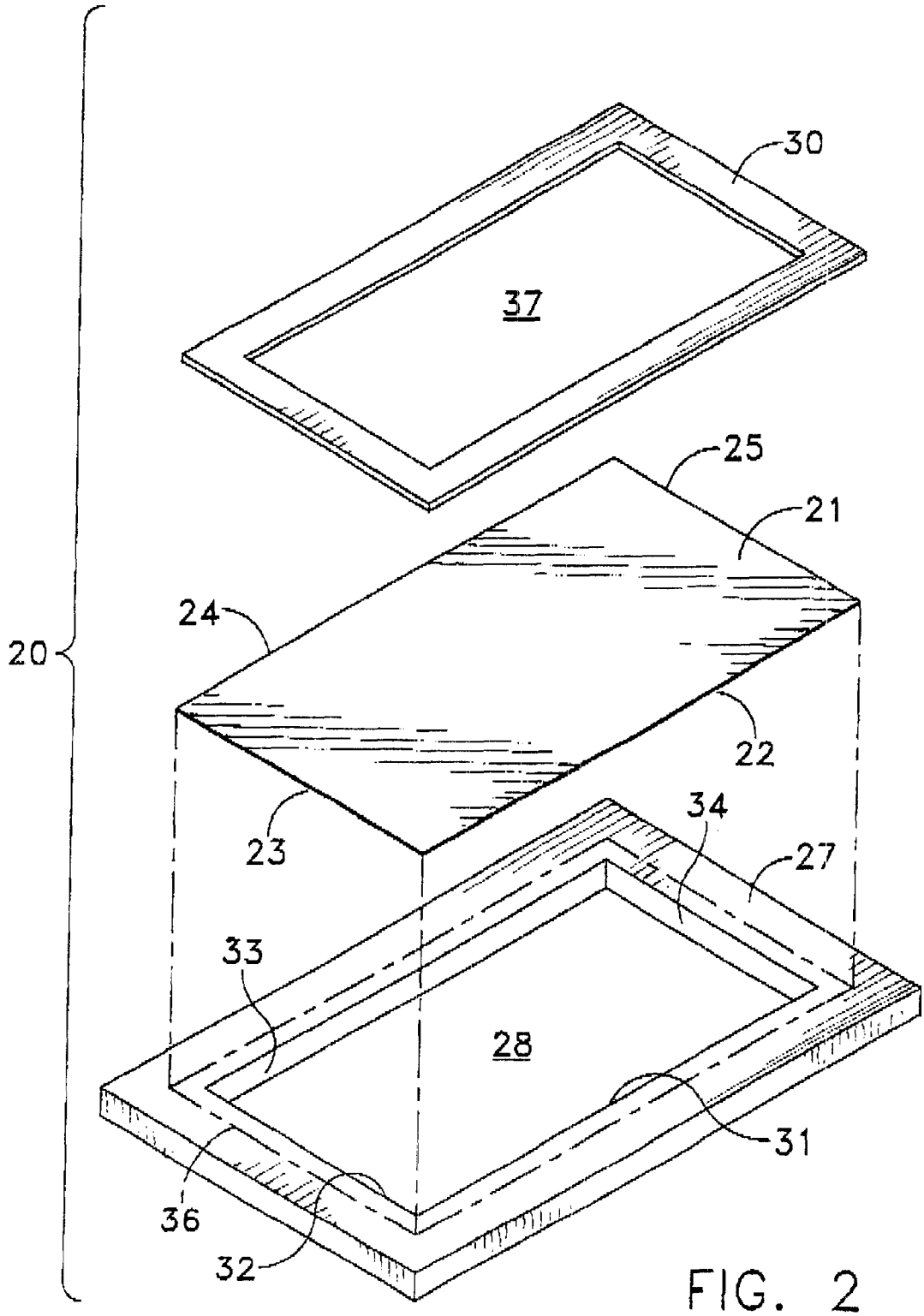
FIG. 2 is an exploded view of the filler shown in FIG. 1.

Referring to FIGS. 1 through 3, a filler 20 embodying this invention includes a flexible panel 21. In this specific embodiment, the flexible panel 21 is composed of a flexible transparent sheet material, such as a transparent film with edges 22 through 25. A two-piece peripheral frame 26 supports the panel 21. The peripheral frame 26 includes a planar base frame 27 and a cover 30.

The base frame 27 has an inner central rectangular opening 28 defined by inner edges 31 through 34. The frame 27 is formed of a closed cell foam having a first density and having two characteristics. First, material should be sufficiently flexible to allow the base frame 27 to be folded as particularly shown in FIG. 4 and described later. Second, the foam should have sufficient memory to allow the base frame 27 to relax to a substantially planar configuration when no external forces are applied to the base frame 27. The panel 21 overlies the opening 28 with portions of the panel 21 at the edges 22 through 25 overlying portions of the base frame 27 at adjacent the edges 31 through 34 as depicted by dashed line boundary 36.

As specifically seen in FIGS. 1 and 3, the cover 30 has a rectangular shape with a central opening 37 that is generally coextensive with the opening 28. The cover 30 can be formed from a variety of materials including a closed cell foam. However, the cover 30 need not have any memory characteristics. Consequently, the cover 30 can be significantly less dense and thinner than the base frame 27. In FIGS. 1 through 3 the cover 30 overlies the portions of the central panel 21 that extend beyond the edges 31 through 34 and may also extend beyond the dashed line 36. However, the cover 30 need not be fully coextensive with the base frame 27. In this embodiment, the cover 30 extends just to the outside of the panel 21 as shown by the position of the edge 23 in FIG. 3.

As stated, the base frame 27 and the cover 30 are composed of different closed cell foams. As a specific example, for a companionway the base frame 27 is cut from a ⅝" sheet of polyethylene with a density of about 2.2 lbs/ft$^3$ and the cover is cut from a ⅜" sheet of polyethylene foam with a density of about 1.2 lbs/ft$^3$. Polyethylene foam with a density of 2.2 lbs/ft$^3$ exhibit sufficient flexibility and memory for filler applications in accordance with this invention. Other foams that exhibit the required characteristics are available commercially.

As shown most clearly in FIG. 3, the panel 21, the base frame 27 and the cover 30 form a laminated structure in cross-section bonded together by an adhesive or other bonding means or method. Consequently, the base frame 27 and cover 30 support the panel 21 by capturing the edges of the panel 21 extending beyond the openings 28 and 37.

Still referring to FIGS. 1 through 3, the area of the panel 21 is a significant portion of the total area of the filler 20. The closed cell foam base frame 27 and cover 30 are lightweight so the total weight of the structure is minimal. Further, as the closed cell foam forming the base frame 27 has a memory, the base frame 27 tends to maintain a planar configuration even after repeated and prolonged folding operations.

Figure 4:
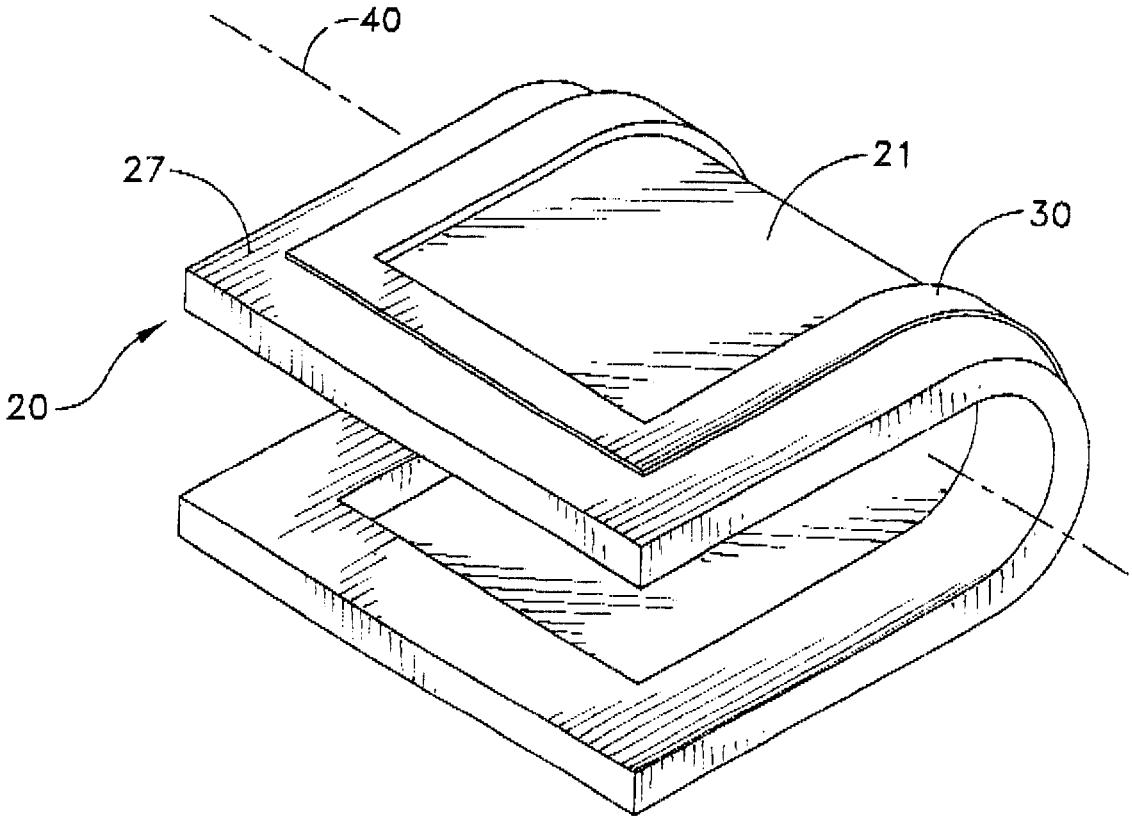
FIG. 4 is a perspective view of the filler shown in FIGS. 1 through 3 folded for storage.

The filler 20 shown in FIGS. 1 through 3 can be stored in a variety of configurations. Obviously it can be stored in the planar configuration in FIGS. 1 through 3. Alternatively, and as shown in FIG. 4, the filler 20 can be folded about an axis, such as an axis 40 parallel to the plane of the filler 20. This allows an individual to store a filler 20 as shown in FIGS. 1 through 4 in a flat configuration under or behind a cushion in the cabin or in a folded configuration for storage in a locker or cubicle.

Figure 5:
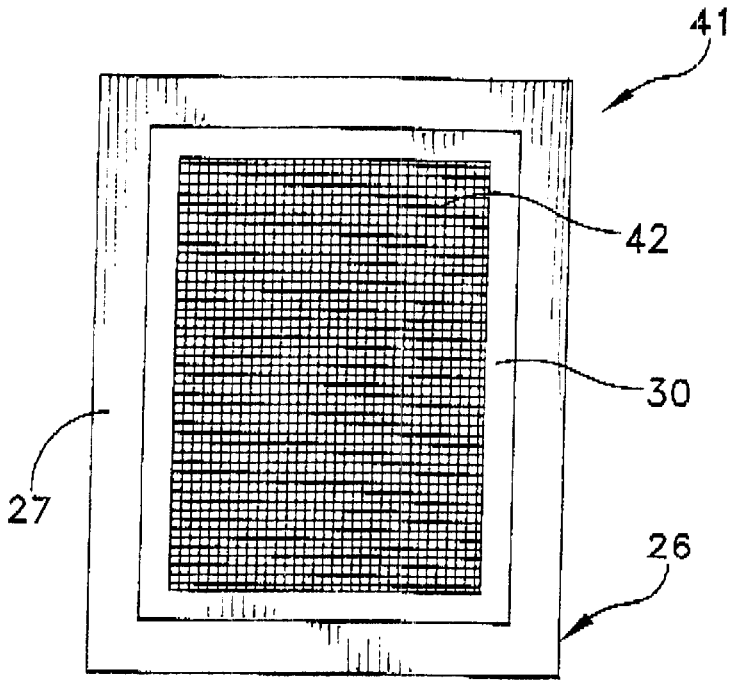
FIG. 5 is a plan view of an alternate embodiment of the filler of FIG. 1 utilizing a screen panel.

The use of film or other flexible transparent solid material to form the panel 21 allows light to pass through the filler 20 while blocking any other elements such as rain, wind or pests. FIG. 5 depicts a similar structure in the form of a filler 41 with a mesh screen central panel 42 preferably formed of a fiberglass screen or any other material that can withstand repeated folding operations and the environment. The filler 41 uses a peripheral frame 26 including the main frame element 27 and a cover 30. As will be apparent, the filler 41 with its screen allows air to pass through the opening while blocking the passage of insects.

Figure 6:
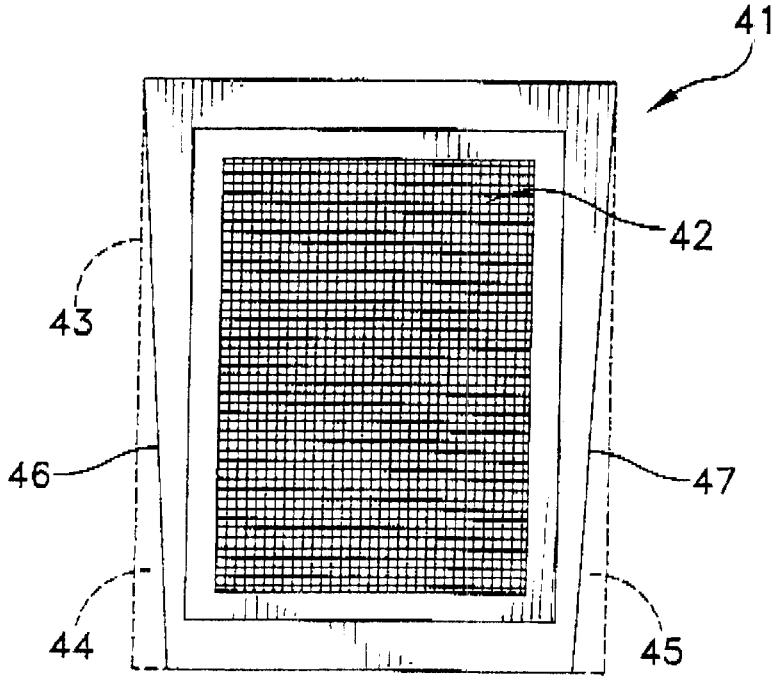
FIG. 6 depicts the filler of FIG. 5 modified for a non-rectangular opening.

Referring to FIGS. 5 and 6, this invention allows a filler of a given size to be adapted readily for openings of different configurations. For example, in many applications, particularly boating applications, the companionway sides are not parallel but taper inward. FIG. 5 discloses a rectangular filler 41 with dashed lines 43 in FIG. 6 depicting that original outline. In FIG. 6 portions 44 and 45 have been removed so that the sides 46 and 47 have the same taper as a companionway or other tapered opening. The use of closed cell foams enables portions to be removed accurately and easily with a straightedge and knife.

Oftentimes, gaps may exist between various structural members even after a filler is installed. For example, in a boat gaps often exist between the tops of the companionway and the companionway cover when the companionway cover is closed. The unused portions 44 and 45 can be shaped to form removable plugs for use in blocking any such gaps.

Figure 7:
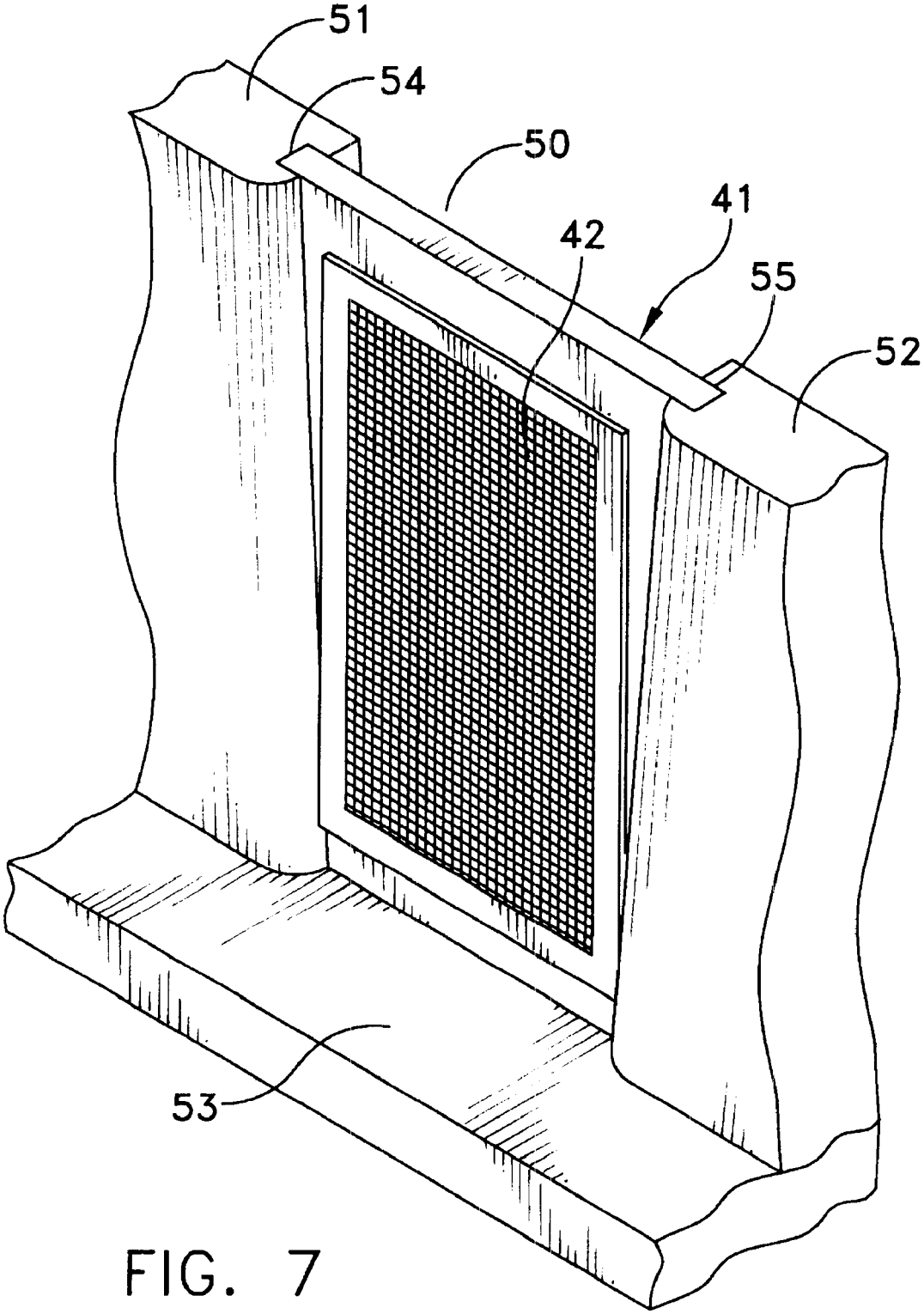
FIG. 7 depicts the installation of a filler constructed in accordance with this invention in channels of a structure.

FIG. 7 depicts one approach for mounting a filler, such as the filler 20 in FIGS. 1 through 4 or the filler 41 in FIGS. 5 and 6. This specific example depicts the insertion of the filler 41 in a companionway 50 through a bulkhead with a left bulkhead portion 51 and a right bulkhead portion 52 and over a bridge deck 53. The companionway 50 tapers from a maximum width at the top to a minimum width at the bridge deck 53. In this particular application, the bulkhead portion 51 and 52 have counterfacing channels 54 and 55. The filler 41 is modified as shown in FIG. 6 so that the taper of sides 46 and 47 matches the taper of the channels 54 and 55. When the filler 41 is inserted, the channels 54 and 55 secure the filler 41 in the companionway 50. Thus the structure in FIG. 7 represents an opening through a structure that includes a preexisting channel or other support structure which can support the filler 41.

Figure 8:
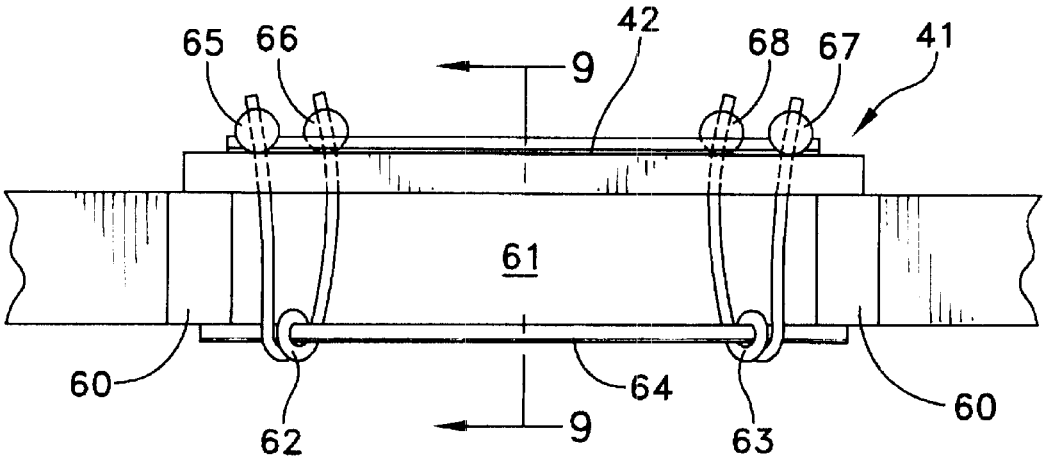
FIG. 8 depicts the installation of a filler constructed in accordance with this invention for a structure with no channels or like supporting elements.
Figure 9:
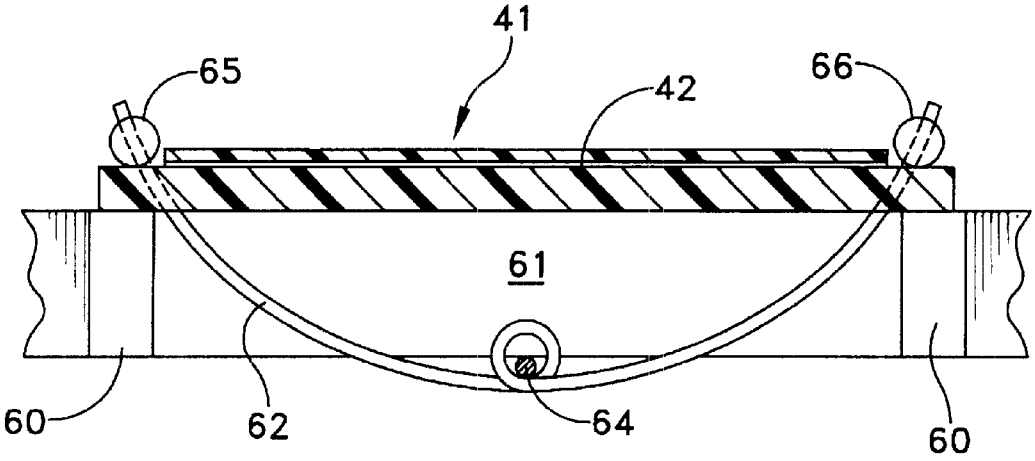
FIG. 9 is a section taken along lines 9—9 in FIG. 8.

Some openings do not have any channels or like support structures. For example, a horizontal hatch in a boat may comprise a plain rectangular frame with no support structures. Screens can be attached to the overhead inside the cabin, but it is preferable to cover the exterior of the hatch. A filler constructed in accordance with this invention may be sized to fit snugly in the opening. The light weight of the filler will make any such fit reasonably reliable. FIGS. 8 and 9 depict another technique that uses a simple fastening structure for clamping a filler, such as the filler 40, to a hatch frame 60 to overlie the hatch opening 61. The filler 41 carries two elastic cords 62 and 63 and clamping bar, such as a dowel 64, that spans the hatch frame 60. The elastic cords 62 and 63 can be loosely tied to the dowel 64. The free ends of the elastic cords 62 and 63 extend through the filler 41 and terminate in stoppers or locks 65 and 66, respectively. Similar stoppers or locks 67 and 68 are associated with elastic cord 63.

In use, an individual positions the filler 41 on top of the hatch frame 60 and guides the dowel 64 through the hatch opening 61 to span the hatch frame 60. Alternatively, the dowel 64 could be removed and inserted from below the hatch frame 60. In either event, the cords 62 and 63 can then be tightened by pulling their ends through the stoppers 65, 66, 67 and 68 until there was firm pressure on the elastic cords 62 and 63. This then clamps the filler 41 against the top of the hatch frame 60. Thus the filler 41 overlies the hatch opening 61 and is held firmly in place even in windy conditions.

Figure 10:
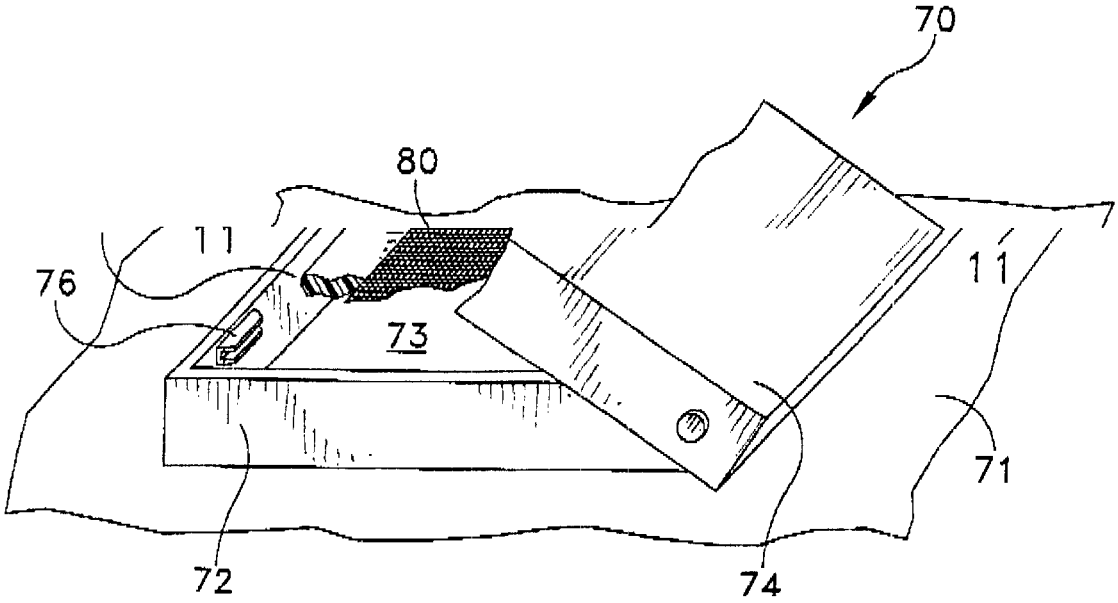
FIG. 10 is a perspective view of a covered hatch with a filler.
Figure 11:
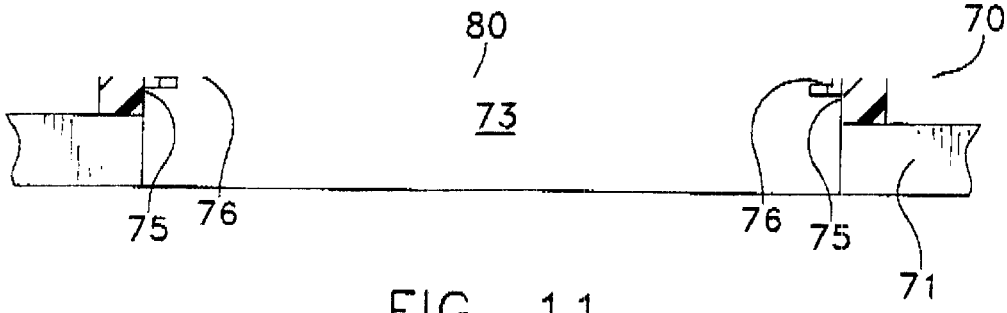
FIG. 11 is a section of a portion of the covered hatch taken along lines 11—11 in FIG. 10.

FIG. 10 depicts another type of covered hatch 70 as might be installed through a deck 71. It comprises a rectangular frame 72 that defines an opening 73 and a pivoted cover 74. An internal wall 75 defines the periphery of the opening 73. Many such hatches additionally include a hatch cover clamp with one component mounted in the cover and the other on the hatch wall. FIGS. 10 and 11 depict a hatch cover clamp with dogs 76 spaced about the periphery that interact with adjustable hooks (not shown) in the cover 74. For such an installation, a filler 80 can be sized to the opening 73 and then lowered to rest on top of the dogs 76. In this position the filler 80 is supported without introducing excessive weight onto the dogs 76. The filler 80 can also be easily installed or removed from the interior of a boat cabin.

As will now be apparent, the fillers 20, 41 and 80 are representative of a class of fillers constructed in accordance with this invention using a closed cell foam frame having a density and memory characteristic that enable a rectangular open frame to be folded and then, when unrestrained and relaxed, return to a substantially planar configuration. This filler can be adapted for use with the different types of structures without requiring any modification of a structure about the opening. It will also be apparent that the central panel constitutes a significant portion of the filler. The flexibility of the structure facilitates its storage in other than a flat configuration. As will also be apparent a single sized filler can be adapted for many different openings that are both rectangular and non-rectangular. Moreover, this combination of features is achieved in a lightweight, floatable filler that is simple and inexpensive to manufacture and simple to use.

This invention has been disclosed in terms of certain embodiments. It will be apparent that many modifications can be made to the specifically disclosed embodiments. Different rectangular and non-rectangular configurations could be adapted. Specific foam compositions have been disclosed; still others could be substituted. Transparent flexible solid panels and screen mesh panels have been shown; other materials and elements could be substituted. The disclosed fillers are shown with discrete covers of closed cell foam. The primary purpose of the cover is to interact with the panel and base frame member to produce a bond between the panel and the base frame that is reliable after repeated folding operations. Other materials and components, such as different types of tape or layers of adhesive might be substituted. The cover might also be constituted by an insert or flap formed in the base frame. Each of these substitutions or combinations thereof could be made with the attainment of some or all of the objectives of this invention. Therefore, it is the intent of the appended claims to cover all such variations and modifications as come within the true spirit and scope of this invention.

What is claimed as new and desired to be secured by Letters Patent of the United States is:

1. A filler for an opening through a structure comprising:

A) a flexible panel, and

B) a planar base frame with an opening therethrough for supporting the panel, said base frame being composed of a closed cell foam material with density, memory and flexibility characteristics that allow the frame to be folded and to relax to a substantially planar configuration, and C) a cover having a density that is less than the density of said planar base frame material with an opening therethrough coextensive with the opening through said base frame whereby said cover is at least as flexible as said planar base frame and whereby said base frame and cover support said panel by capturing the edges thereof.

2. A filler as recited in claim 1 wherein said frame member is composed of polyethylene foam with a density of about 2.2 lbs/ft$^3$ and wherein said cover is composed of a polyethylene foam with a density of 1.2 lbs/ft$^3$.

3. A filler as recited in claim 1 wherein said panel comprises a flexible transparent material.

4. A filler as recited in claim 1 wherein said panel comprises a screen.

5. A filler as recited in claim 1 wherein the structure opening has a predetermined size and configuration and wherein the central panel is circumscribed by the opening, said foam having the characteristic of being easily trimmed to conform to the opening.

6. A filler as recited in claim 1 wherein the structure opening has counterfacing spaced channels and said frame member thickness is less than the channel width whereby the edge portions of said frame member are positioned in the channels.

7. A filler as recited in claim 1 wherein said filler additionally comprises clamping means for attaching said filler to the structure at the opening.

8. A filler as recited in claim 7 wherein said filler is adapted to lie on a first side of the structure and said clamping means comprises:

i) a clamping bar for spanning the opening with end portions thereof engaging a second side of the structure, and ii) a plurality of spaced flexible connectors carried by said peripheral frame for engaging said clamping bar, and iii) locking means connected to said connectors whereby said connectors can be drawn through said peripheral frame thereby to draw said clamping against said peripheral frame and to clamp said filler to the structure that is intermediate said filler and said clamping bar.

* * * * *